United States Patent [19]

Livingston

[11] Patent Number: 4,538,499

[45] Date of Patent: Sep. 3, 1985

[54] DRUM BEATING APPARATUS

[76] Inventor: Duane P. Livingston, 1025 17th St., Apt. A, Santa Monica, Calif. 90402

[21] Appl. No.: 457,967

[22] Filed: Jan. 14, 1983

[51] Int. Cl.[3] ..... G10D 13/00

[52] U.S. Cl. ..... 84/422 R

[58] Field of Search ..... 84/422 C, 422 R

[56] References Cited

U.S. PATENT DOCUMENTS

| | | | |
|---|---|---|---|
| 2,845,830 | 8/1958 | Haviland | 84/422 |
| 3,195,391 | 7/1965 | Peters | 84/422 |
| 3,543,632 | 12/1970 | La Flame | 84/453 |
| 3,742,806 | 7/1973 | Zalmer | 84/422 |
| 3,750,517 | 8/1973 | Sleishman | 84/422 |
| 3,797,356 | 3/1974 | Duffy | 84/422 |
| 3,968,718 | 7/1976 | Carver | 84/422 R |
| 4,188,853 | 2/1980 | Bills | 84/422 R |

*Primary Examiner*—L. T. Hix
*Assistant Examiner*—Douglas S. Lee
*Attorney, Agent, or Firm*—William W. Haefliger

[57] ABSTRACT

The invention concerns enhancement of the utility of drum beating apparatus, and more particularly concerns provision for adjustability and stability of drum single and dual beaters, drives therefor, and supports for the drives. Selective positioning and usage of single or dual drum beaters are provided, in modes accommodating adjustable positions of left and right foot bases associated with the drummer's feet.

21 Claims, 11 Drawing Figures

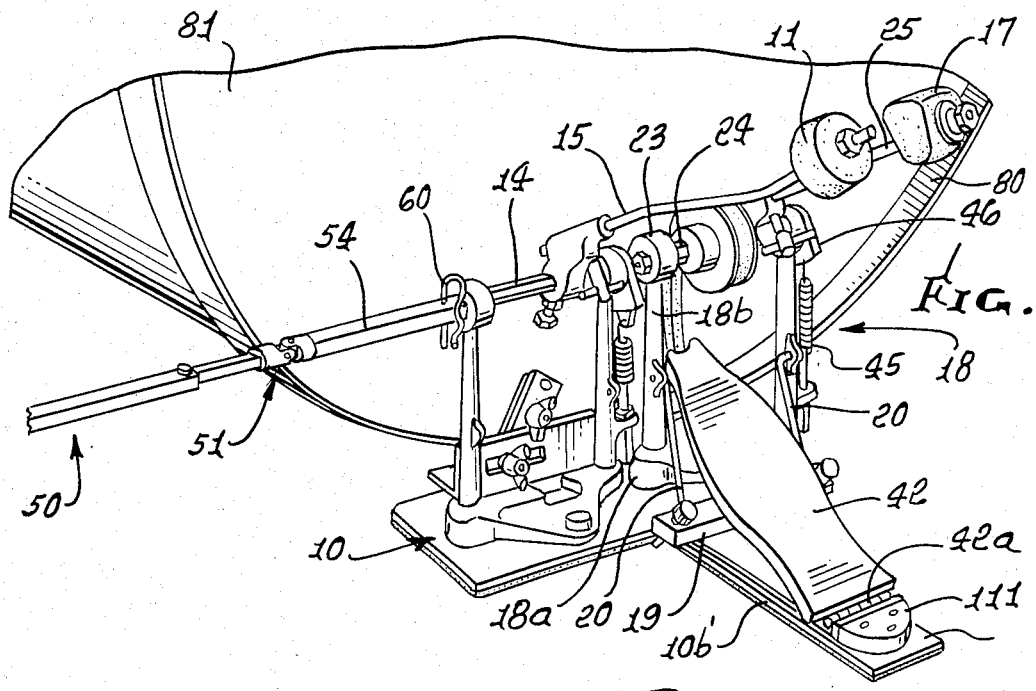
FIG. 8.
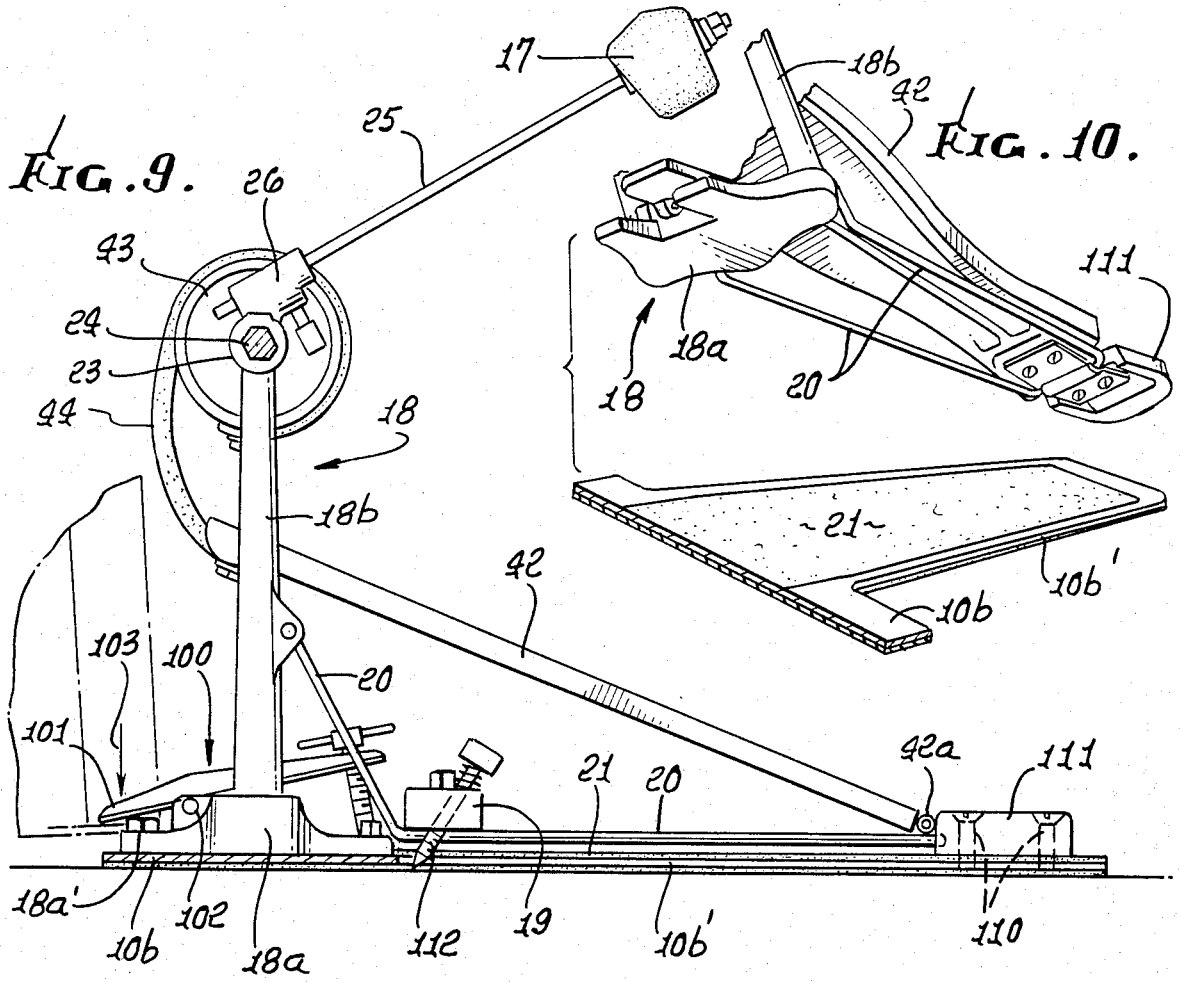
FIG. 9.
FIG. 10.

DRUM BEATING APPARATUS

BACKGROUND OF THE INVENTION

This invention relates generally to enhancement of the utility of drum beating apparatus, and more particularly concerns provision for adjustability and stability of drum single and dual beaters, drives therefor, and supports for the drives. Selective positioning and usage of single or dual drum beaters are provided, in modes accommodating adjustable positions of left and right foot bases associated with the drummer's feet.

Prior drum beating mechanisms as disclosed for example in U.S. Pat. Nos. 2,845,830; 3,195,391; 3,543,632; 3,742,806; 4,188,853; and 3,750,517 lacked the unusual advantages and combinations of advantages, structurally and functionally, of the present invention, whereby the present invention represents a substantial and unusual advance over the prior art, and fills a need for such advantages.

SUMMARY OF THE INVENTION

Basically, the invention operatively combines:

(a) a first base, a first drum beater and first support therefor mounted on the first base, (b) a second base, and a foot operated drive on the second base, the second base adjustably movable to a selected position relative to the first base, (c) coupling means, including at least one universal joint, intercoupling the foot operated drive and the first drum beater, and (d) the first base having a lateral portion to optionally receive and carry a second drum beater, a second support therefor and a second foot operated drive for the second beater.

As will appear, the second drum beater, second support and second drive are carried by said laterally extending portion of the first base, in separate and laterally offset relation to said first beater and first support therefor; and structure may fixedly support the second support and pivotally support the second drive, whereby a separate (self-contained) drum beating unit is provided and may be adjustably positioned downwardly on the laterally extending portion of the first base, to be carried by it.

Additional features include the provision of telescoping shafts associated with the U-joints; the provision of two U-joints, for enhancing relative angular positioning of the bases; the provision of rapidly positioned lock pins for telescopically interconnected drive parts; and the provision of clamp means to clamp the drum rim at a selected elevation as well as at the lowest position of the rim.

These and other objects and advantages of the invention, as well as the details of an illustrative embodiment, will be more fully understood from the following specification and drawings: in which:

DRAWING DESCRIPTION

FIG. 8 is a perspective of a modification showing another beater in place;

FIG. 9 is a side elevation of the added beater shown in FIG. 8;

FIG. 10 is a perspective view of the support for the added beater of FIGS. 8 and 9.

DETAILED DESCRIPTION

Figures 1, 2, 3, 11:
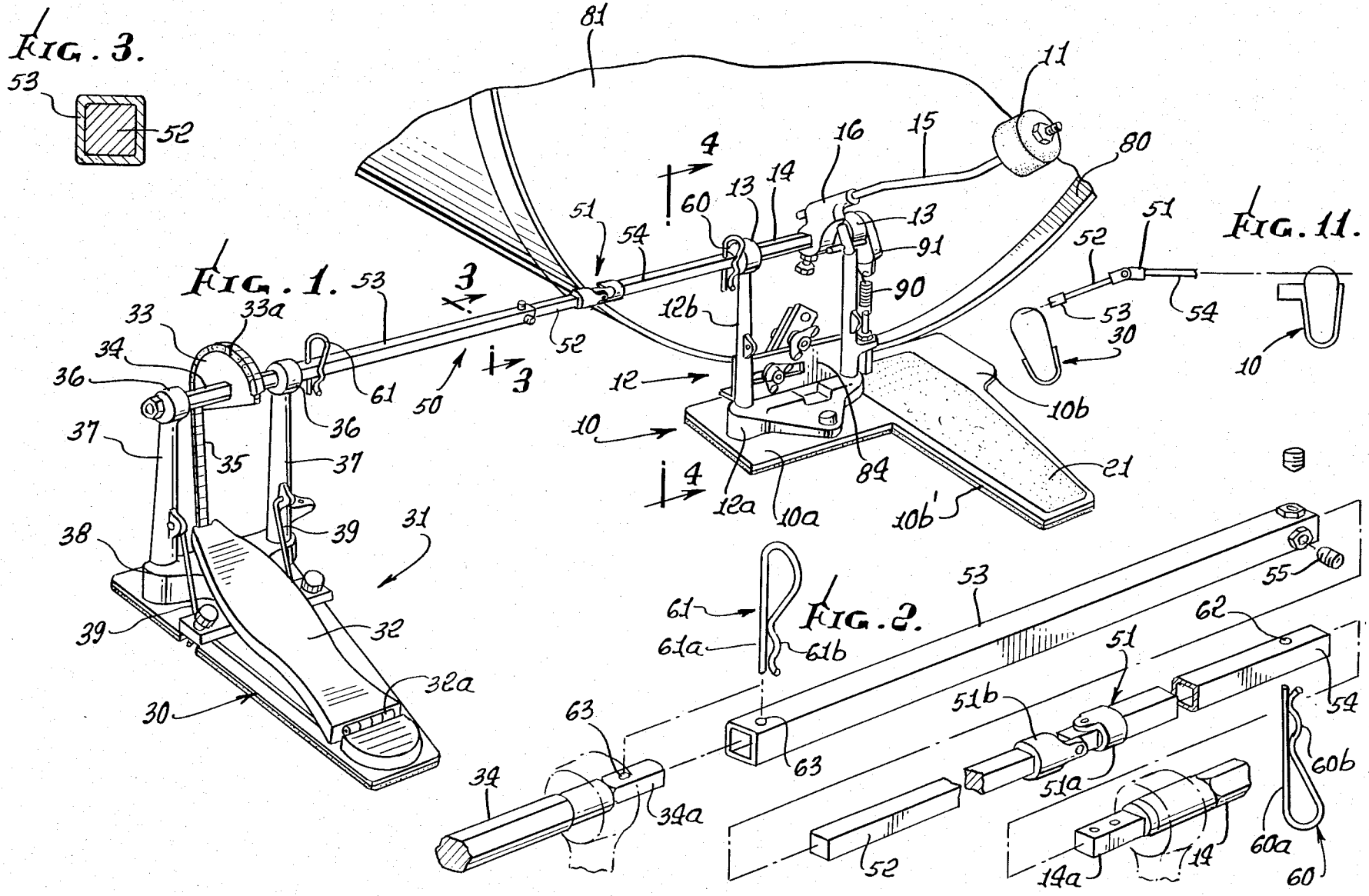
FIG. 1 is a perspective view of one preferred form of the invention.
FIG. 2 is an enlarged perspective view of a coupling arrangement.
FIG. 3 is an enlarged section on lines 3—3 of FIG. 1.
FIG. 11 is a schematic view.
Figure 4:
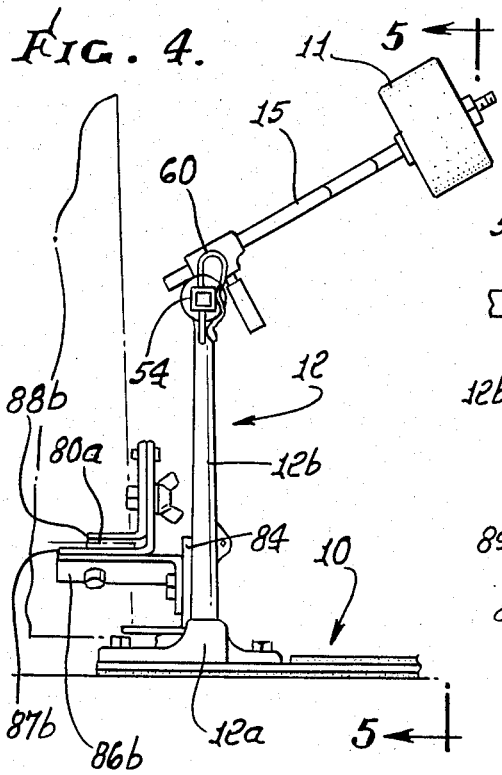
FIG. 4 is a vertical secion taken on lines 4—4 of FIG. 1.
Figure 5:
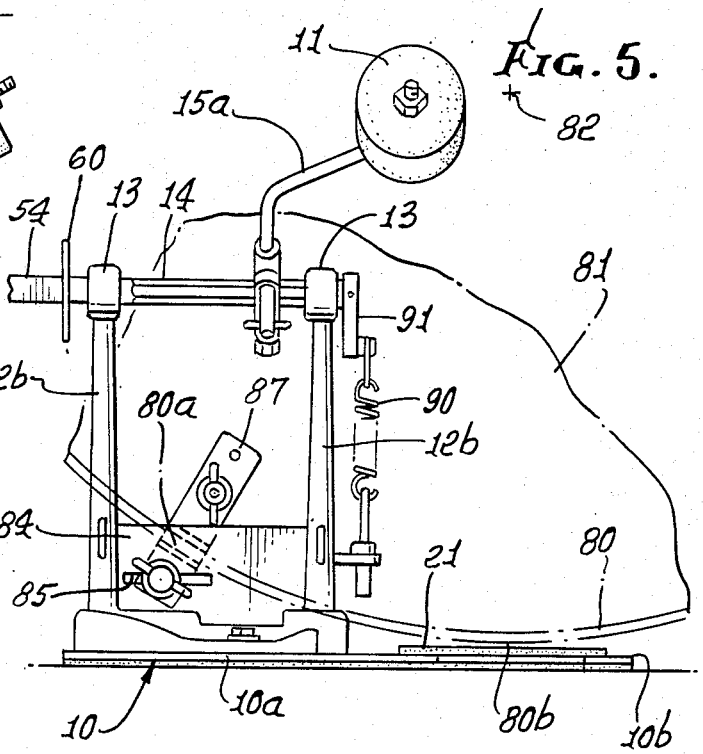
FIG. 5 is a vertical elevation on lines 5—5 of FIG. 4.
Figure 6:
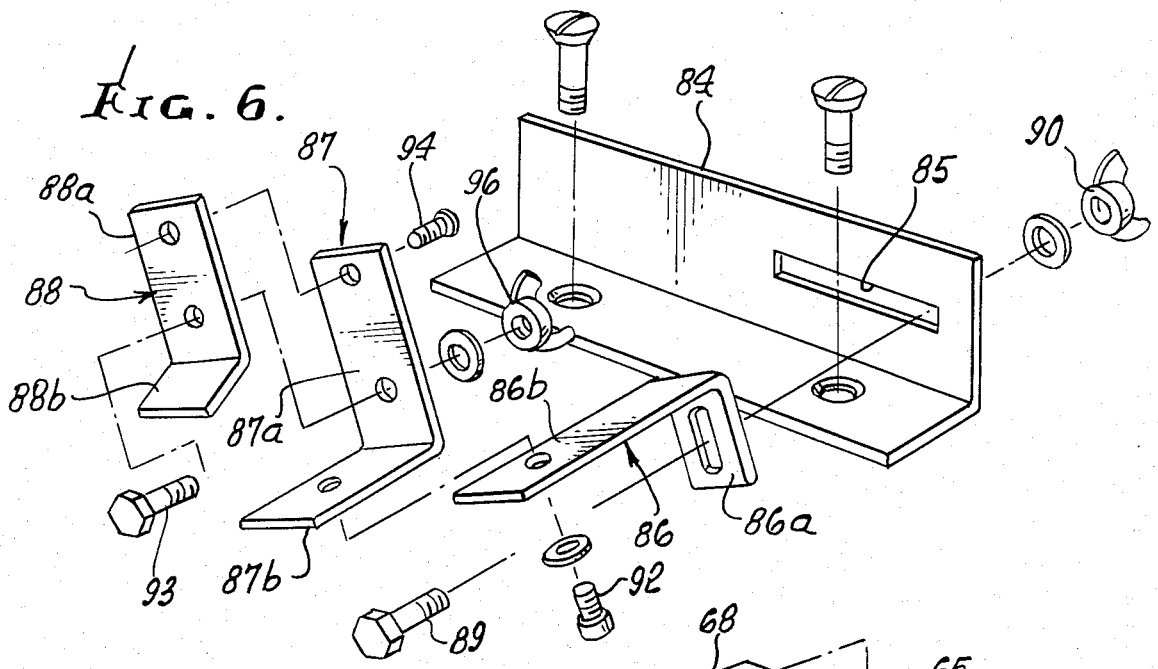
FIG. 6 is an exploded perspective showing details of an attachment.

In FIGS. 1, 4 and 5, a first base 10 has the form of a base plate including a first portion 10*a* supporting a first drum beater 11. The support 12 for the beater includes a bottom yoke 12*a* and two upright pedestals 12*b* carrying bearing sleeves 13 for a horizontal shaft 14 to which beater shaft 15 is connected at 16. Yoke 12*a* connects to base 10.

The first base 10 has a laterally extending portion 10*b* to optionally receive and carry a second drum beater 17 (see FIGS. 8–10) as via a second support 18 therefor placed downwardly on the first plate. A second bar 19 may be provided to fixedly support the second support, as for example via brace members 20, the latter adapted to be placed downwardly on a rearward extension 10*b*′ of the first plate lateral portion 10*b*. Screws 110 attach heel 111 to rearward extension 10*b*′, and rods 20 connect to heel 111. If desired, frictional material such as high strength felt may be proved at 21 to hold the base of 18, and heel 111 on first plate extension 10*b*′ when optional bar 19 is not used. Members 20 are retained to plate 10*b* by bar 19, and project upwardly and forwardly to connect to pedestals 18*b* the lower ends of which are carried by a yoke 18*a* adjustably seating on first plate lateral extension 10*b* (see FIG. 9). Pedestals 18*b* carry bearing sleeves 23 for a horizontal shaft 24 to which beater shaft 25 is connected at 26.

From the above, it is clear that beater 17 is positionally adjustably relative to beater 11; beater 17 may be easily replaced or removed relative to base 10, as desired; and the shafts 14 and 24 for the two beaters are not connected with one another. Beater shaft 15 may also be angled or offset at 15*a* (see FIG. 5) so that the two beaters 11 and 17 are close together.

Referring back to FIG. 1, a second base 30 is provided, remotely from the first base 10, and is positionally adjustable relative thereto, to be selectively angled to best suit the drummer's feet positions. See also FIG. 11. A left foot operated drive is provided on or associated with the second base, and is generally indicated at 31. That drive is shown to include a foot pedal 32 the heel of which is pivotally connected at 32*a* to base 30; a rotor 33 on a horizontal shaft 34, and a flexible coupling such as a chain 35 connected to the toe of the pedal and wrapping on sprocket teeth 33*a* on rotor 33. Shaft 34 is carried in bearing 36 on pedestals 37, the latter supported via yoke 38 on base 30 in the form of a plate. Brace members 39 also support the pedestals to the base. Yoke 38 connects to base 30. Return spring 90 connected to shaft 14 via crank 91 returns the beater to retracted position.

In similar manner, in FIGS. 8–10, foot pedal 42 is pivotally connected at 42*a* to plate 10*b*′. Rotor 43 on shaft 24 is connected to the toe end of the pedal, as via belt 44 fitting in the rotor sheave, so that up-down oscillation of the pedal oscillates the drum beater 17. Return spring 45 connected to shaft 24 via crank 46 returns the beater to retracted position.

Coupling means, including at least one universal joint (U-joint), intercouples the foot operated drive 31 and the first drum beater 11. To this end, FIGS. 1 and 2 show the coupling means 50 to include U-joint 51 having section 51*a* connected to shaft 54 endwise receiving end 14*a* of shaft 14, and section 51*b* connected to shaft member 52. The latter has endwise telescoping connection to shaft member 53. Member 53 endwise receives end 34*a* of shaft 34. Set screw 55 received in member 53 may be tightened against member 52 to set the relative telescopic positions of members 52 and 53, in accordance with desired separation of bases 10 and 30. U-joint 51 accommodates angular positioning of shafts 54, and 52 and 53. See FIG. 11. Members and parts 14*a*', 54, 52, 53, and 34*a* are polygonal in cross section to transmit the drive.

Locks 60 and 61 have pins 60*a* and 61*a* receivable through side openings 62 in the members 54 and 14*a*, and openings 63 in the members 53 and 34*a*. Lock clamp pins 60*b* and 61*b* clamp the sides of members 54 and 53, to position the pins 60*a* and 61*a*, and lock the described members together. The locks are very easily inserted into clamping position, are removed, by the drummer, as he is setting up his equipment, or disassembling the latter.

Figure 7:
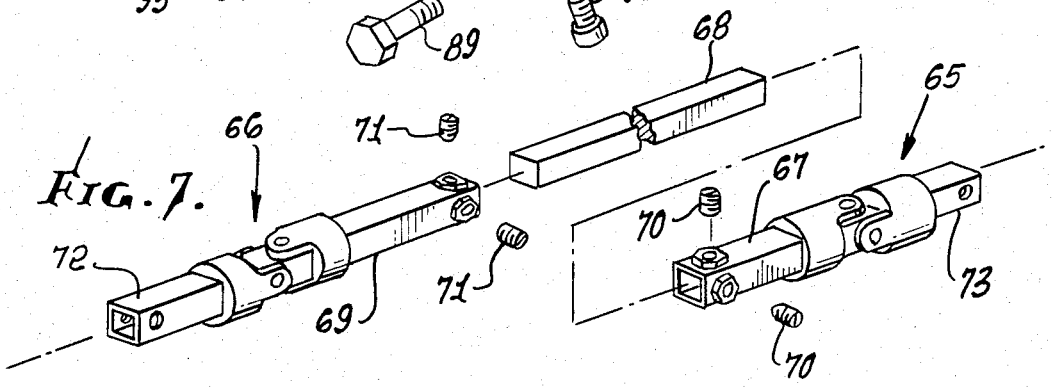
FIG. 7 is a perspective showing a modified coupling.

FIG. 7 shows a modification wherein two U-joints 65 and 66 are employed. Joint 65 is connected to sleeve member 67 having endwise telescopic interfit with member 68; and joint 66 is connected to sleeve member 69 having endwise telescopic interfit with member 68. See four set screws 70 and 71. Joint 66 also connects to shaft 34 via member 72, and joint 65 connects with shaft 14 via member 73.

Also provided as shown in FIGS. 4 and 5 is a first clamp means on the first base 10 and angularly supported to clamp the rim 80 of a drum 81 at a location 80*a* above the level of the lowest portion 80*b* of the rim, for enhancing drum stability relative to the plate 10 and beater 11, with or without beater 17. The drum in such position has a horizontal axis 82 about which rim 80 extends. The clamp means includes, for example, a clamp plate 84 upstanding from and connected to the base 10, and having slot 85 cut therethrough, with length as shown to adjustably pass a fastener 89. Rim clamping structure is adjustably attached to plate 84, via slot 85, and may include L-brackets 86, 87 and 88. Bracket 86 has leg 86*a* through which bolt shank 89 extends, as well as through the slot 85, a wing nut 90 being tightenable on the shaft and against the plate to provide adjusted positioning of bracket 86. The latter supports brackets 87 and 88, a bolt 92 connecting bracket legs 86*b* and 87*b*; and bolts 93 and 94 connecting bracket legs 87*a* and 88*a*. The drum rim is gripped between bracket 87*b* and 88*b*, when wing nut 96 is tightened on bolt 93.

Another clamp 100 is associated with the second drum beater support to clamp the lowest portion of the rim, as shown in FIG. 9. That clamp may include a lever 101 pivoted at 102 on yoke 18*a* and spring urged in the direction of arrow 103, to press the rim (via its inner side) down on yoke surface 18*a*'. Accordingly, adjustable gripping of the rim at two points (at different elevations) is achieved, for enhancing drum and beater support stability.

In FIG. 1, base 10 rearward extension 10*b*' provides a right foot pad for the drummer to position the base 10 and the drum, when only the one beater 11 is being used.

In the above, the term "U-joint" is intended to embrace the types of joints illustrated, as well as other types of constant velocity (angled) couplings.

In FIG. 9, screws 112 thread into the bar 19, and penetrate the floor, to fixedly position the support 18.

I claim:

1. In a drum beating assembly, the combination comprising (a) a first base in the form of a first plate, a first drum beater and first support therefor mounted on the first base, (b) a second base in the form of a second plate, and a foot operated drive on the second base, one base adjustably movable to a selected position relative to the other base, (c) coupling means, including at least one universal joint, intercoupling the foot operated drive and the first drum beater, and (d) the first base having a laterally extending portion to optionally receive and carry a second support for a second drum beater to be driven by a second foot operated drive, (e) and including said second drum beater, second support and a second drive which are carried by said laterally extending portion of the first base, in separate and laterally offset relation to said first beater first support, (f) each of said first and second supports including two upright pedestals and a yoke supporting the pedestals, the first support yoke attached to the first base, and the second support yoke spaced from the first yoke and adjustably supported on said laterally extending portion of the first base.

2. The combination of claim 1 including a heel fixedly supporting said second support and pivotally supporting said second drive, said heel received downwardly on said laterally extending portion of the first base to be carried thereby.

3. The combination of claim 2 wherein said first and second drives include pedals which are remotely separated and located at relatively angled position as accommodated by said universal joint.

4. The combination of claim 1 wherein said coupling means includes horizontally extending telescoping members which are adjustable to permit adjustable separation of said bases.

5. The combination of claim 4 wherein said members have polygonal cross sections.

6. The combination of claim 1 wherein said coupling means includes a first generally horizontal shaft operatively connected with the first drum beater, and a second generally horizontal shaft operatively connected with the foot operated drive on the second base, the universal joint transmitting rotary motion between said shafts.

7. The combination of claim 6 wherein the coupling means includes a second universal joint transmitting rotary motion between said shafts, and a horizontally adjustable connection between said univeral joints.

8. The combination of claim 7 wherein said connection includes relatively telescopically interfitting parts.

9. The combination of claim 1 including first clamp means on the first base and angularly supported to clamp the rim of a drum at a location above the level of the lowest portion of the rim.

10. The combination of claim 9 including said drum having said rim which extends circularly about a horizontal axis, the lowest portion of the rim located adjacent the lateral portion of the first base to be clamped when said second drum beater is supported in general alignment with said lowest portion of the rim.

11. The combination of claim 10 including a clamp associated with the second drum beater support to clamp the lowest portion of the rim.

12. The combination of claim 9 wherein said clamp means includes a clamp plate upstanding from the first base and having an arcuate slot therethrough and extending generally upwardly, and rim clamping structure adjustably attached to the plate via said slot.

13. The combination of claim 1 including beater shafts carrying said beaters, at least one beater shaft angled relative to the other to locate the beaters in side by side relation.

14. The combination of claim 6 wherein the first shaft has telescopic interfit with a support shaft for the drum beater, and the second shaft has telescopic interfit with a support shaft for a foot operated drive rotor, and means to removably hold said interfits in assembled condition.

15. The combination of claim 14 wherein said last named means comprise U-shaped lock pins.

16. In a drum beating assembly, the combination comprising (a) a first base in the form of a plate, a first drum beater and first support therefor mounted on the first base, (b) a second base in the form of a plate, and a foot operated drive on the second base, the second base adjustably movable to a selected position relative to the first base, (c) coupling means, including at least one universal joint, intercoupling the foot operated drive and the first drum beater, and (d) said coupling means including a first generally horizontal shaft operatively connected with the first drum beater, and a second generally horizontal shaft operatively connected with the foot operated drive on the second base, the universal joint transmitting rotary motion between said shafts, (e) said bases comprising plates, said first and second supports each including two pedestals and a yoke supporting the pedestals, the yokes respectively attached to said first and second bases.

17. The combination of claim 16 wherein the coupling means includes a second universal joint transmitting rotary motion between said shafts, and a horizontally adjustable connection between said universal joints.

18. The combination of claim 14 wherein said interfits are polygonal.

19. In a drum beating assembly, and for use in combination with a second base and a foot operated drive on the second base, the improvement comprising:

(a) a first base in the form of a plate, a first drum beater and first support therefor mounted on the first base, the first support including two pedestals and a yoke supporting the pedestals and attached to the first plate, (b) coupling means, including at least one universal joint, for intercoupling the foot operated drive and the first drum beater, and (c) the first base having a laterally extending plate portion spaced from said pedestals and yoke to optionally receive and carry a second support for a second drum beater to be driven by a second foot operated drive.

20. The combination of claim 19 including said second drum beater, second support and a second drive which are carried by said laterally extending portion of the first base, in separate and laterally offset relation to said first beater first support.

21. The combination of claim 1 including a heel fixedly supporting said second support and pivotally supporting said second drive, said heel received downwardly on said laterally extending portion of the first base to be carried thereby.

* * * * *